US005785899A

United States Patent [19]

Young

[11] Patent Number: 5,785,899

[45] Date of Patent: Jul. 28, 1998

[54] AERATING ROTOR WITH SUBMERSIBLE PLANETARY GEARBOX

[75] Inventor: Richard Nils Young, Atlanta, Ga.

[73] Assignee: DBS Manufacturing, Inc., Forest Park, Ga.

[21] Appl. No.: 823,212

[22] Filed: Mar. 24, 1997

[51] Int. Cl.[6] ..... B01F 3/04

[52] U.S. Cl. ..... 261/91

[58] Field of Search ..... 261/91

[56] References Cited

U.S. PATENT DOCUMENTS

| | | | |
|---|---|---|---|
| 1,374,446 | 4/1921 | Greenawalt . | |
| 1,766,643 | 6/1930 | Janes . | |
| 2,054,395 | 9/1936 | Streander . | |
| 2,609,097 | 9/1952 | Dering . | |
| 2,633,344 | 3/1953 | Rekk . | |
| 2,802,647 | 8/1957 | Bolton | 261/91 |
| 2,827,268 | 3/1958 | Staaf . | |
| 3,154,601 | 10/1964 | Kalinske et al. . | |
| 3,182,972 | 5/1965 | Alsop et al. . | |
| 3,323,782 | 6/1967 | Clough | 261/91 |
| 3,360,460 | 12/1967 | Weston . | |
| 3,576,316 | 4/1971 | Kaelin | 261/91 |
| 3,704,868 | 12/1972 | Weis | 261/91 |
| 3,741,682 | 6/1973 | Robertson . | |
| 3,814,395 | 6/1974 | Kaelin . | |
| 4,074,953 | 2/1978 | Budde et al. . | |
| 4,123,482 | 10/1978 | Wyatt et al. . | |
| 4,151,231 | 4/1979 | Austin et al. . | |
| 4,152,082 | 5/1979 | Jellesma . | |
| 4,681,711 | 7/1987 | Eaton | 261/91 |
| 5,522,989 | 6/1996 | Hove . | |

*Primary Examiner*—Tim R. Miles

*Attorney, Agent, or Firm*—Needle & Rosenberg, P.C.

[57] ABSTRACT

An apparatus for aerating a liquid, having a surface, employs a motor having a rotating member and a non-rotating member. A shaft is coupled to the rotating member of the motor. Also coupled to the shaft is an input of a planetary gear assembly, comprising stationary upper portion and a rotatable lower portion. The rotatable lower portion is coupled to the axial section of an aeration rotor so that as the aeration rotor is placed in the liquid, a portion of the planetary gear assembly is in contact with the liquid, thereby facilitating cooling of the planetary gear assembly by the liquid. The planetary gear assembly also comprises a seal between the stationary upper portion and the rotatable lower portion disposed above the liquid and disposed above substantially all of the oil in the planetary gear assembly so as to inhibit spillage of oil from the planetary gear assembly into the liquid if the seal fails. A torque tube having a first end and an opposite second end connects the motor to the planetary gear assembly. The first end is affixed to the non-rotating member of the motor and the second end is affixed to the upper stationary portion of the planetary gear assembly. The torque tube also defines a lengthwise passage passing therethrough. The shaft passes through the lengthwise passage, so that the torque tube maintains the upper stationary portion of the planetary gear assembly in a fixed relationship to the non-rotating member of the motor.

12 Claims, 3 Drawing Sheets

AERATING ROTOR WITH SUBMERSIBLE PLANETARY GEARBOX

BACKGROUND OF THE INVENTION

1. Field of the Invention

This invention relates to a method and apparatus for aerating a liquid. More particularly, this invention relates to a method and apparatus for aerating liquids using a gearbox that may be cooled by the liquid being aerated.

2. The Prior Art

Currently available aerators for aerating liquids, such as sewage sludge and the like, include high-speed spray aerators and low-speed rotor aerators. Low-speed aerators are more energy efficient than high-speed aerators. However, low-speed aerators require the use of heavy duty speed reducers. Therefore, high-speed aerators are less expensive and more commonly used.

As shown in FIG. 1, a typical prior art low-speed rotor aerator 1 used for aerating liquids 3, comprises an aeration rotor 2 coupled to a shaft 4 that is, in turn, coupled to a gearbox 6. The gearbox is driven by a motor 8, which causes the gearbox 6 to rotate the shaft 4, thereby rotating the aeration rotor 2. The aeration rotor 2 agitates the liquid 3, thereby mixing air with the liquid 3.

Such aerators generally rotate at a rate of between 30 RPM to 60 RPM and operate continuously for extremely long periods. Low speed aerators have an advantage over high speed spray aerators in that they are more energy efficient. However, such aerators have difficulty dissipating heat from oil in the gearbox 6 and often require additional oil pumps, or other complicated equipment, to allow them to cool while operating over extended periods. Furthermore, if certain of the seals on such aerators fail, oil can spill from the gearbox into the liquid being aerated, thereby causing an environmental hazard.

If the gearbox were of the vertically mounted sealed-unit type, such as a planetary gearbox, the aerator would be relatively simple in construction and the potential for environmental hazards resulting from oil spillage would be minimized. However, existing planetary gearboxes suitable for low-speed aeration have only a limited oil supply and lack the ability to be cooled over extended periods of continuous operation. Thus, they would tend to overheat during continuous operation and, therefore, they are not commonly used in low-speed aerators.

SUMMARY OF THE INVENTION

The above-noted disadvantages of the prior art are overcome by the present invention, which in one aspect is an apparatus for aerating a liquid, comprising an aeration rotor having an axial section. A planetary gear assembly is coupled to the axial section and comprises an input, a stationary upper portion and a rotatable lower portion. The rotatable lower portion is coupled to the axial section of the aeration rotor so that as the aeration rotor is placed in the liquid, a portion of the planetary gear assembly is in contact with the liquid, thereby facilitating cooling of the planetary gear assembly by the liquid. The distal end of a shaft, having a proximal end and an opposite distal end, is coupled to the input of the planetary gear assembly. A motive unit for rotating the shaft, such as a motor, is coupled to the proximal end of the shaft. When the motive unit rotates the shaft, the shaft causes the planetary gear assembly to rotate the aeration rotor.

In another aspect of the invention, the planetary gear assembly also comprises a seal between the stationary upper portion and the rotatable lower portion disposed above the surface of the liquid and substantially all of the oil in the planetary gear assembly so as to inhibit spillage of oil from the planetary gear assembly into the liquid if the seal fails.

Yet another aspect of the invention is an apparatus for aerating a liquid, having a surface, comprising a motor having a rotating member and a non-rotating member. A shaft is coupled to the rotating member of the motor. The shaft has a proximal end, coupled to the rotating member, and an opposite distal end. Coupled to the distal end of the shaft is an input of a planetary gear assembly, comprising a stationary upper portion and a rotatable lower portion. The rotatable lower portion is coupled to the axial section of an aeration rotor so that as the aeration rotor is placed in the liquid, a portion of the planetary gear assembly is in contact with the liquid, thereby facilitating cooling of the planetary gear assembly by the liquid. The planetary gear assembly also comprises a seal between the stationary upper portion and the rotatable lower portion disposed above the surface of the liquid and substantially all of the oil in the planetary gear assembly so as to inhibit spillage of oil from the planetary gear assembly into the liquid if the seal fails.

A torque tube maintains the upper stationary portion of the planetary gear assembly in a fixed relationship to the non-rotating member of the motor. The torque tube has a first end and an opposite second end that connects the motor to the planetary gear assembly. The first end is affixed to the non-rotating member of the motor and the second end is affixed to the upper stationary portion of the planetary gear assembly. The torque tube also defines a lengthwise passage passing therethrough. The shaft passes through the lengthwise passage of the torque tube. The torque tube may be affixed to a beam, or other structure connected to a tank containing the liquid being aerated, thereby providing a rigid support for the aerator.

An advantage of the invention is that cooling of the gear assembly is accomplished by the liquid being aerated, thereby eliminating the need for cooling devices associated with the gear assembly.

A further advantage of the invention is that it prevents oil from spilling into the aerated liquid if the seal of the gear assembly fails.

These and other advantages will become apparent from the following description of the preferred embodiment taken in conjunction with the following drawings, although variations and modifications may be effected without departing from the spirit and scope of the novel concepts of the disclosure.

DETAILED DESCRIPTION OF THE INVENTION

Figure 1:
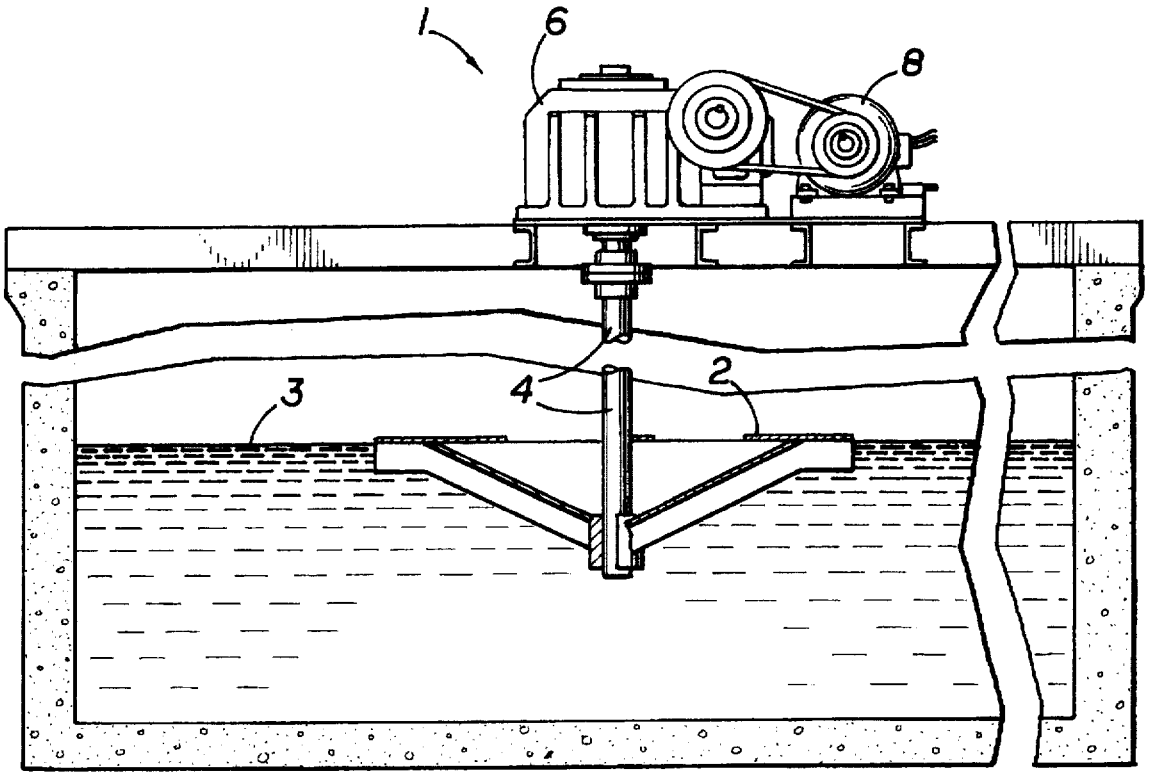
PRIOR ART FIG 1
FIG. 1 is a side elevational view of a prior art aerator.

A preferred embodiment of the invention is now described in detail. Referring to the drawings, like numbers indicate like parts throughout the views. As used in the description herein and throughout the claims that follow, "a," "an," and "the" includes plural reference unless the context clearly dictates otherwise. Also, as used in the description herein and throughout the claims that follow, the meaning of "in" includes "in" and "on" unless the context clearly dictates otherwise.

Figure 2:
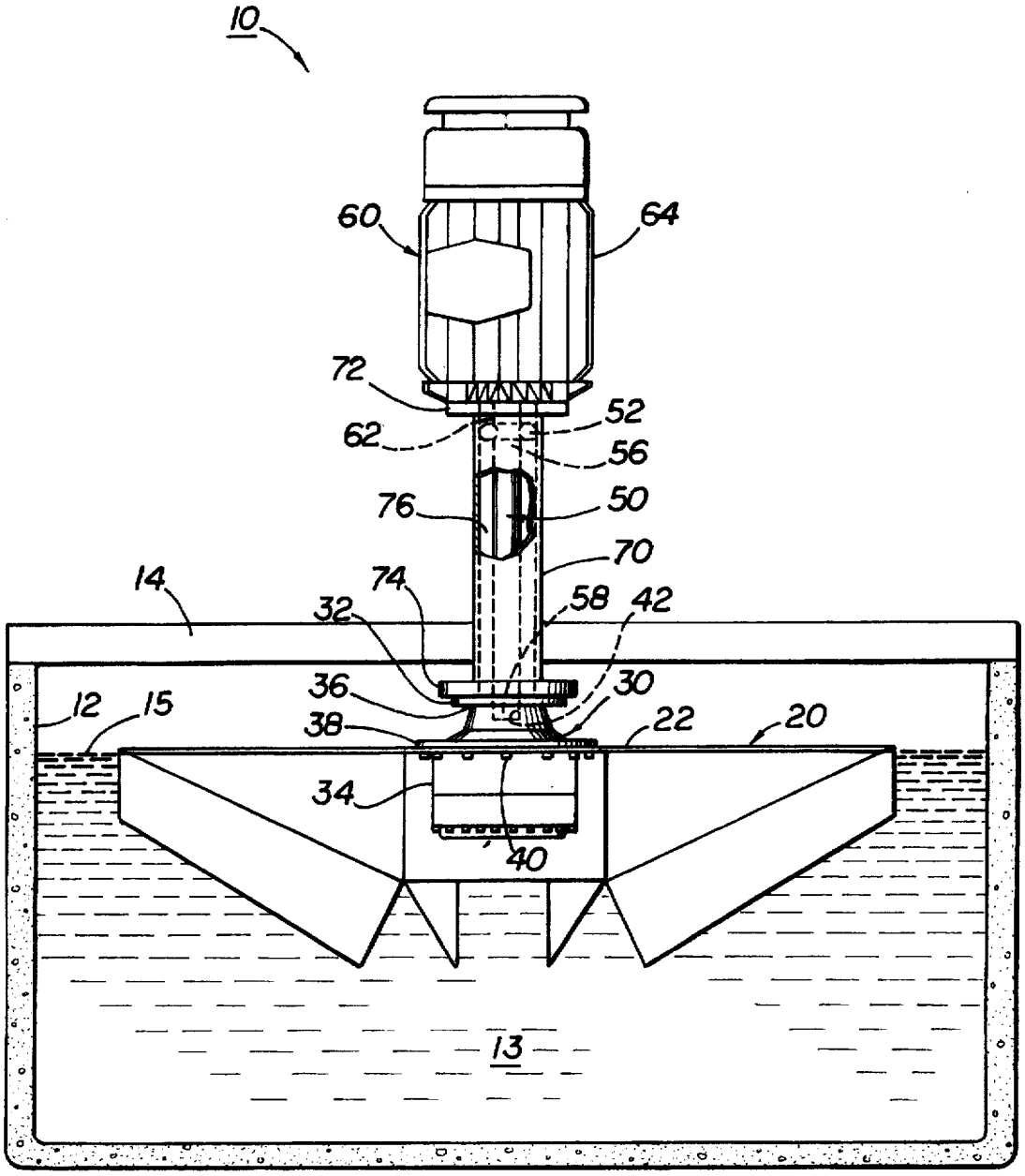
FIG. 2 is a side elevational view of one embodiment of the invention.
Figure 3:
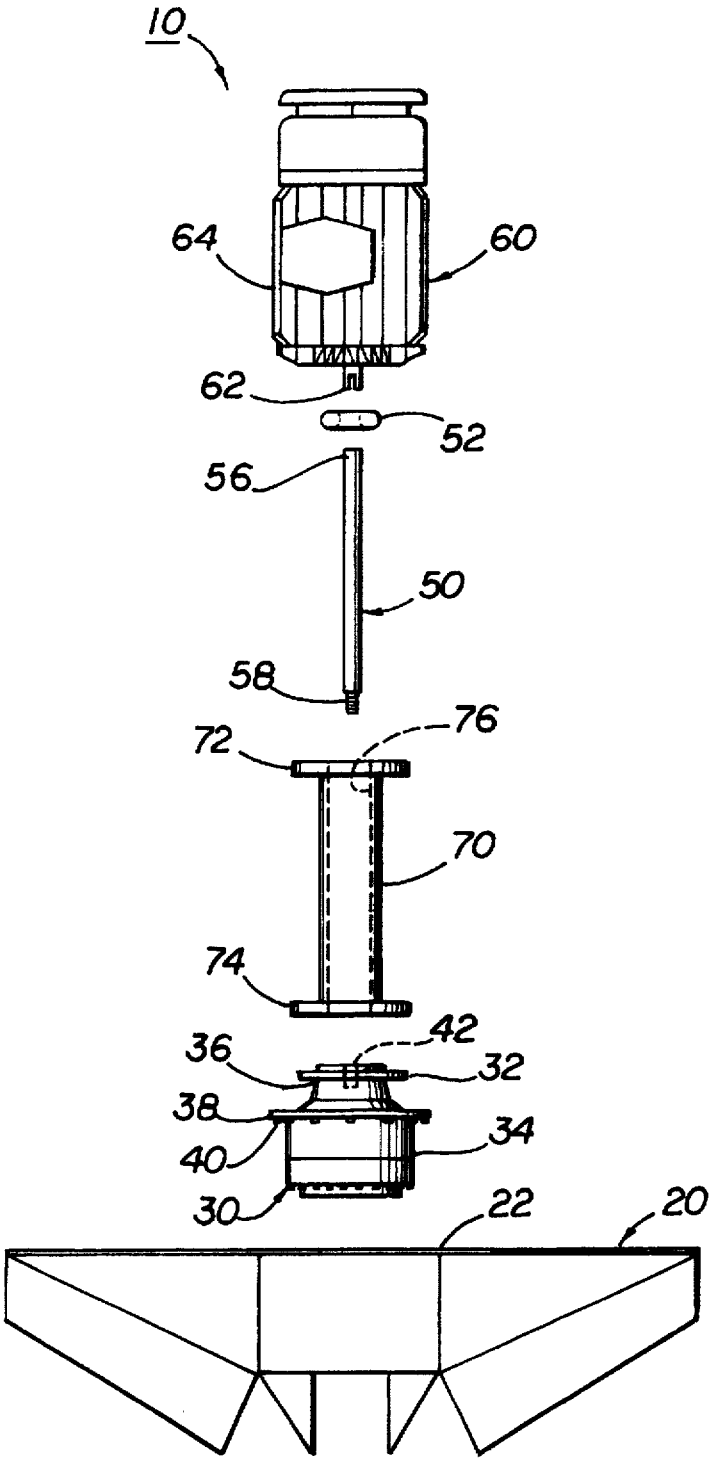
FIG. 3 is an exploded side elevational view of the embodiment shown in FIG. 1.

In the preferred embodiment, as shown in FIG. 2, the invention is an apparatus 10 for aerating a liquid 13, having a surface 15. The apparatus 10 includes a motor 60 having a rotating member 62 and a non-rotating member 64. A shaft 50, having a proximal end 56 and an opposite distal end 58, receives rotational force from the motor 60, with the proximal end 56 being coupled, through a coupler 52, to the rotating member 62 of the motor 60. For most aerating applications, the motor 60 would be an electric motor, rated in the range of 15 to 150 horsepower. However, it will be appreciated that many other horsepower ratings could be used for certain applications without departing from the scope of the invention. Furthermore, non-electric motors, such as hydraulic motors and internal combustion engines, could be used in some applications, as would be know to those skilled in the art.

An aeration rotor 20, of several types commonly known to the art, having an axial section 22, is provided for agitating the liquid 13. The aeration rotor 20 and the shaft 50 are both coupled to a planetary gear assembly 30. Thus, as the motor 60 rotates the shaft 50, the shaft 50 causes the planetary gear assembly 30 to rotate the aeration rotor 20.

The planetary gear assembly 30 includes an input 42 (such as the input spline shown, or an input shaft) coupled to the distal end 58 of the shaft, for receiving rotational force therefrom. The planetary gear assembly 30 also includes a stationary upper portion 32 and a rotatable lower portion 34. The rotatable lower portion 34 is coupled to the axial section 22 of the aeration rotor 20 so that as the aeration rotor 20 is placed in the liquid 13, a portion of the planetary gear assembly 30 is disposed under the surface 15 of the liquid and is in contact with the liquid 13, thereby facilitating cooling of the planetary gear assembly 30 by the liquid 13 being aerated. The planetary gear assembly 30 also has a seal 36 between the stationary upper portion 32 and the rotatable lower portion 34. The seal 36 is disposed above the liquid 13 and disposed above substantially all of the oil (not shown) in the planetary gear assembly 30 so as to inhibit spillage of oil from the planetary gear assembly 30 into the liquid 13 if the seal 36 were to fail.

The apparatus 10 is held stationary with respect to the tank 12 by a torque tube 70 that is secured to a beam 14, or other rigid structure, affixed to the tank 12. The torque tube 70 has a first end 72 and an opposite second end 74. The first end 72 is affixed to the non-rotating member 64 of the motor 60 and the second end 74 is affixed to the upper stationary portion 32 of the planetary gear assembly 30. The torque tube 70 defines a lengthwise passage 76, through which the shaft 50 passes, so that the torque tube 70 maintains the upper stationary portion 32 of the planetary gear assembly 30 in a fixed relationship to the non-rotating member 64 of the motor 60.

The planetary gear assembly 30 could comprise a wheel drive (which is also commonly referred to as a "track drive" or a "planetary final drive") of the type commonly used with heavy machinery, such as earth-moving equipment. The planetary gear assembly 30 may be of the type that has a flange 38 extending radially from rotatable lower portion 34 to which the axial section 22 of the aeration rotor 20 is affixed with a plurality of bolts 40. Examples of suitable wheel drives include models W20D, W1B and W7C Planetary Final Drives available from Fairfield Manufacturing Company, Inc., U.S. 52 South, Lafayette, Ind. 47902. Another example is Series RML from Reggiana Riduttori of Italy.

Because the planetary gear assembly 30 uses the liquid 13 as its cooling medium, the present invention does not require any sort of oil cooling apparatus. Thus, the aerator of the present invention, because of its simplicity, has the efficiency advantages of low-speed aerators, but is price competitive with high-speed aerators.

The above described embodiment is given as an illustrative example only. It will be readily appreciated that many deviations may be made from the specific embodiment disclosed in this specification without departing from the invention. Accordingly, the scope of the invention is to be determined by the claims below rather than being limited to the specifically described embodiment above.

What is claimed is:

1. An apparatus for aerating a liquid, comprising:

a. an aeration rotor having an axial section;

b. a planetary gear assembly, comprising an input, a stationary upper portion and a rotatable lower portion, the rotatable lower portion being coupled to the axial section of the aeration rotor so that as the aeration rotor is placed in the liquid, a portion of the planetary gear assembly is in contact with the liquid, thereby facilitating cooling of the planetary gear assembly by the liquid;

c. a shaft, having a proximal end and an opposite distal end, the distal end being coupled to the input of the planetary gear assembly; and d. means, coupled to the proximal end of the shaft, for rotating the shaft, whereby when the rotating means rotates the shaft, the shaft causes the planetary gear assembly to rotate the aeration rotor.

2. The apparatus of claim 1, wherein the rotating means comprises a non-rotating member, the apparatus further comprising a torque tube having a first end and an opposite second end, the first end being affixed to the non-rotating member of the rotating means and the second end being affixed to the stationary upper portion of the planetary gear assembly, the torque tube defining a lengthwise passage passing therethrough, the shaft passing through the lengthwise passage, so that the torque tube maintains the stationary upper portion of the planetary gear assembly in a fixed relationship to the non-rotating member of the rotating means.

3. The apparatus of claim 1, wherein the planetary gear assembly comprises a seal between the stationary upper portion and the rotatable lower portion disposed above the liquid and disposed above substantially all of the oil in the planetary gear assembly so as to inhibit spillage of oil from the planetary gear assembly into the liquid if the seal fails.

4. The apparatus of claim 1, wherein the planetary gear assembly comprises a wheel drive.

5. The apparatus of claim 1, wherein the rotating means comprises an electric motor.

6. An apparatus for aerating a liquid, having a surface, comprising:

a. an aeration rotor having an axial section;

b. a planetary gear assembly, comprising an input, a stationary upper portion and a rotatable lower portion, the rotatable lower portion being coupled to the axial section of the aeration rotor, the planetary gear assembly also comprising a seal between the stationary upper portion and the rotatable lower portion disposed above the liquid and disposed above substantially all of the oil in the planetary gear assembly so as to inhibit spillage of oil from the planetary gear assembly into the liquid if the seal fails;

c. a shaft, having a proximal end and an opposite distal end, the distal end being coupled to the input of the planetary gear assembly; and d. means, coupled to the proximal end of the shaft, for rotating the shaft, whereby when the rotating means rotates the shaft, the shaft causes the planetary gear assembly to rotate the aeration rotor.

7. The apparatus of claim 6, wherein the rotating means comprises a non-rotating member, the apparatus further comprising a torque tube having a first end and an opposite second end, the first end being affixed to the non-rotating member of the rotating means and the second end being affixed to the stationary upper portion of the planetary gear assembly, the torque tube defining a lengthwise passage passing therethrough, the shaft passing through the lengthwise passage, so that the torque tube maintains the stationary upper portion of the planetary gear assembly in a fixed relationship to the non-rotating member of the rotating means.

8. The apparatus of claim 6, wherein the planetary gear assembly comprises a wheel drive.

9. The apparatus of claim 6, wherein the rotating means comprises an electric motor.

10. An apparatus for aerating a liquid, having a surface, comprising:

a. a motor having a rotating member and a non-rotating member;

b. a shaft, having a proximal end and an opposite distal end, the proximal end being coupled to the rotating member of the motor;

c. an aeration rotor having an axial section;

d. a planetary gear assembly, comprising an input coupled to the distal end of the shaft, a stationary upper portion and a rotatable lower portion, the rotatable lower portion being coupled to the axial section of the aeration rotor so that as the aeration rotor is placed in the liquid, a portion of the planetary gear assembly is in contact with the liquid, thereby facilitating cooling of the planetary gear assembly by the liquid, the planetary gear assembly also comprising a seal between the stationary upper portion and the rotatable lower portion disposed above the liquid and disposed above substantially all of the oil in the planetary gear assembly so as to inhibit spillage of oil from the planetary gear assembly into the liquid if the seal fails; and e. a torque tube having a first end and an opposite second end, the first end being affixed to the non-rotating member of the motor and the second end being affixed to the upper stationary portion of the planetary gear assembly, the torque tube defining a lengthwise passage passing therethrough, the shaft passing through the lengthwise passage, so that the torque tube maintains the upper stationary portion of the planetary gear assembly in a fixed relationship to the non-rotating member of the motor.

11. The apparatus of claim 10, wherein the planetary gear assembly comprises a wheel drive.

12. The apparatus of claim 10, wherein the motor comprises an electric motor.

* * * * *